US010023272B1

(12) United States Patent
O'Neal, Jr. et al.

(10) Patent No.: US 10,023,272 B1
(45) Date of Patent: Jul. 17, 2018

(54) DOUBLE SEAT PEDESTAL

(71) Applicants: Edward J. O'Neal, Jr., Rockingham, NC (US); George L. Smith, Rockingham, NC (US)

(72) Inventors: Edward J. O'Neal, Jr., Rockingham, NC (US); George L. Smith, Rockingham, NC (US)

( * ) Notice: Subject to any disclaimer, the term of this patent is extended or adjusted under 35 U.S.C. 154(b) by 84 days.

(21) Appl. No.: 15/406,874

(22) Filed: Jan. 16, 2017

(51) Int. Cl.
*B63B 29/06* (2006.01)
*B63B 29/04* (2006.01)

(52) U.S. Cl.
CPC ..... *B63B 29/06* (2013.01); *B63B 2029/043* (2013.01)

(58) Field of Classification Search
CPC ... B63B 29/04; B63B 29/06; B63B 2029/043; B63B 2029/046; A47B 91/00; A47B 91/005; A47B 91/08; A47C 7/002; A47C 7/004; Y10T 403/34; Y10T 403/341; Y10T 403/342; Y10T 403/343; Y10T 403/347
USPC ..... 114/363, 364; 248/188.7, 188.8, 520, 248/538; 297/195.12, 195.13, 232–249, 297/257
See application file for complete search history.

(56) References Cited

U.S. PATENT DOCUMENTS

| | | | | | |
|---|---|---|---|---|---|
| 677,195 | A * | 6/1901 | Frederick | A47C 1/08 | 297/240 |
| 1,346,386 | A | 7/1920 | Smolar | | |
| 2,177,387 | A * | 10/1939 | Greitzer | A47B 13/023 | 108/150 |
| 2,845,110 | A * | 7/1958 | Grawl | A47B 85/04 | 297/121 |
| 3,486,790 | A * | 12/1969 | Barecki | A47B 39/00 | 297/142 |
| 3,535,000 | A * | 10/1970 | Protzmann | A47B 83/02 | 248/418 |
| 3,729,226 | A * | 4/1973 | Barecki | A47B 91/08 | 248/188.8 |
| D367,772 | S * | 3/1996 | Stirling | D6/337 | |
| 5,992,804 | A | 11/1999 | Johnson | | |
| 7,370,909 | B2 * | 5/2008 | Gevaert | A47B 83/02 | 248/188.1 |
| 8,573,675 | B2 | 11/2013 | Line | | |
| 2011/0227382 | A1 * | 9/2011 | Hay | A47C 9/022 | 297/242 |
| 2017/0305508 | A1 * | 10/2017 | Thomason | B63B 29/06 | |

OTHER PUBLICATIONS

"EZ.T. Pole Perch." Nov. 15, 2016, http://www.eztpoleperch.com/Double-Seat-Pedestals.html.
"Pyramid (geometry)." Dec. 26, 2016, https://en.wikipedia.org/wiki/Pyramid_(geometry).

* cited by examiner

*Primary Examiner* — Ajay Vasudeva
(74) *Attorney, Agent, or Firm* — James G. Passé; Passé Intellectual Property, LLC

(57) ABSTRACT

In the present invention, there is a single seat pedestal for supporting two seats without further support comprising a tubular pyramid capped with a plate and supporting two arms at right angle to one another.

10 Claims, 4 Drawing Sheets

DOUBLE SEAT PEDESTAL

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a seat pedestal. More particularly, the present invention relates to a single mount seat pedestal for use on a boat deck, or the like, wherein the single pedestal supports 2 seats.

Description of Related Art

The placement of seats on the deck of a boat is usually decided on by the manufacturer of the boat. The position of the seats is determined and seat mounting plates are positioned on the deck so that seats adapted to be used on, such mounting plates, can receive a seat. Manufacturers may or may not provide seats on the mounting plates, and it is not unusual for there to be no seats mounted on all of the mounting plates and these seats being an extra expense.

It is often desirable to add additional seats to a boat beyond what is provided by the manufacturer. In situations where a boat does not have the provision of additional mounting plates, the boat owner is usually faced with an additional expense in adding additional mounting plates or doing without additional seats.

One solution to the problem has been the use of double pedestals that mount to the deck in place of a mounting plate for the addition of two seats where the plate only provides for one regular seat. However, the pedestals to date require additional deck support underneath each of the seats as well as the pedestal or the like attached to the deck making them unusable, where there is no room on the deck for additional support and/or wherein there is a desire to keep the deck clear of additional items so that equipment, fishing gear and the like can be placed on the deck. The problem has been while single pedestals with two arms can support a couch type seat which distributes weight across both arms, such pedestals will not support separate seats and tend to break the seats off over time, if not immediately. There is still a need for a single mount dual seat pedestal that can add 2 seats to a single mounting plate on a boat deck, or other similar situation, for adding two seats with a single mount.

BRIEF SUMMARY OF THE INVENTION

The present invention relates to the discovery that if a pyramidal base construction is utilized along with rectangular metal tubing, a two seat single pedestal can be constructed.

Accordingly, in one embodiment, there is a seat pedestal for mounting two separate seats comprising:

a) a mounting plate base;

b) a front, back, left and right rectangular shaped tubes mounted on the base to form a 4 sided right pyramid having a pyramidal apex;

c) left and right rectangular shaped seat posts, each post having a proximal and distal end wherein the proximal end of each is mounted one each perpendicularly on the corresponding left and right tubes forming the pyramid and the distal end has a seat mounting plate; and d) a stabilizing plate mounted between each of the seat posts and the pyramidal apex.

DETAILED DESCRIPTION OF THE INVENTION

Figure 1:
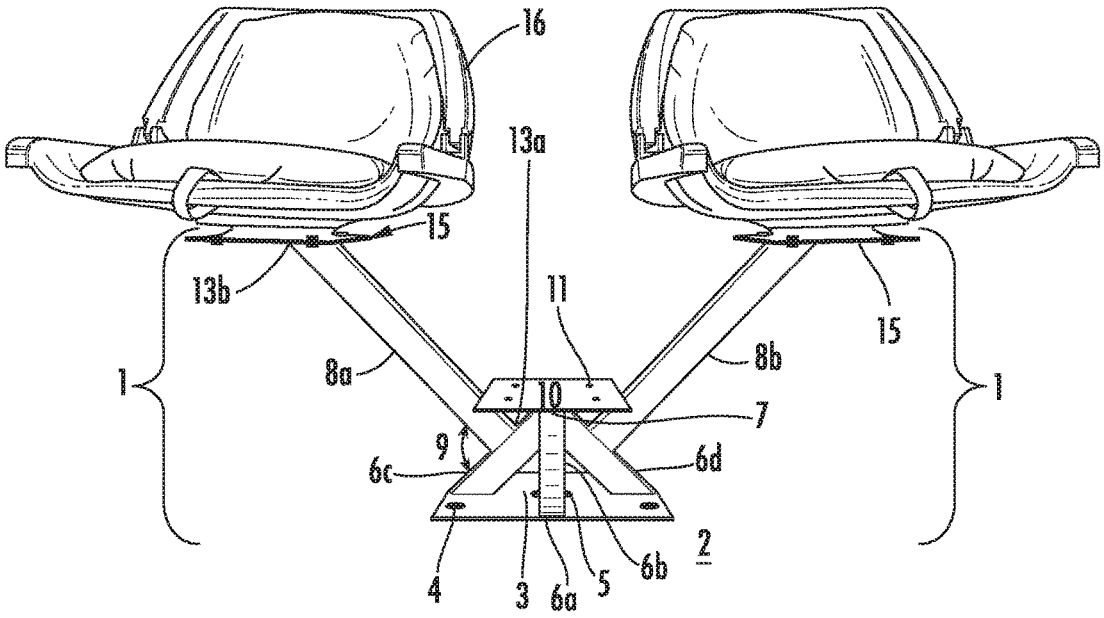
FIG. 1 is a front view of the invention with seats mounted thereon and mounted on a boat deck.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "seat pedestal" refers to a device for supporting a seat, especially a seat pedestal for attaching to the deck of a boat and especially to any mounting plate or post on a boat deck designed to accept a seat pedestal. Typically, a seat pedestal is designed for supporting a single seat. In the present invention, the seat pedestal is designed to support 2 seats on the single pedestal. The strength is such that even if someone sits on just one seat, the pedestal can handle the weight without problems. The seat pedestal, in one embodiment, is made of metal particularly utilizing ⅛" plate steel. Tubing, in one embodiment, is 2" by ¾" with ⅛" thickness (11 gauge). Base and plates are generally about ⅛" thick and rectangular in cross section. Such cross section, in one embodiment, is ¾" by ¾" steel tubing with 1/16" (14 gauge). In one embodiment, the front legs are 2" by ¾" metal tubing and back legs are ¾" by ¾" metal tubing. Seat mounting plates are based on whatever type of seat is desired to be mounted and such plates are within the skill in the art. Metal joining by welding is contemplated for strength but any method which provides equal joining strength of welding is contemplated and within the skill in the art.

As used herein the term "mounting two separate seats" refers to having a single pedestal mounted to a floor and in one embodiment, the deck of a boat that supports two separate seats and people sitting on them. In one embodiment, there are accessories also mounted to the support pedestal. The seats can be boat seats or any seat desired to be mounted utilizing the pedestal of the present invention.

As used herein the term "mounting plate base" refers to an essentially flat metal plate designed for mounting to a floor or boat deck. It can have holes for utilization of screws or bolts to mount to the floor or deck and can also have a hole for utilizing on a boat deck seat post receiver.

As used herein the term "four sided right pyramid" refers to four pieces (left, right, front and back) of rectangular tubing mounted on the mounting plate base to form a 4 sided right pyramidal shape, the pyramid having an apex. In one embodiment, the pyramid is about 6 inches high. The tubing is welded to the base and welded together at the apex. In one embodiment, the left and right tubing has a width dimension greater than the front and back corresponding width. In one embodiment, it is more than twice as wide. A review of the Figures makes this clear to those skilled in the art.

As used herein the term "seat posts" refers to two rectangular shaped seat posts, each post having a proximal and distal end wherein the proximal end of each is mounted one each perpendicularly on the left and right tubes forming the pyramid and the distal end has a seat mounting plate. As described, any kind of seat mounting plate can be utilized based on what kind of seat is desired. While the posts are designed to have two separate seats mounted to them, the pedestal could also be utilized to mount a couch type seat.

As used herein the term "stabilizing plate" refers to a horizontal plate mounted or welded horizontally between each of the seat posts and the pyramidal apex as shown in the Figures. Not only does this plate stabilize the pedestal so that one can sit on just one seat without over stressing the pedestal, it can be utilized to attach accessories e.g. via mounting holes on the plate. Examples of accessories that could be (but not limited to) mounted to the stabilizing plate include cup holder, gun rack or holders, fishing rod holder, umbrella mounting base or stand, ammunition box, tackle box, or cooler.

DRAWINGS

Now referring to the drawings, FIG. 1 is a front perspective of the present invention mounted on a boat deck 2. In this view, seat pedestal 1 is mounted to floor (boat deck 2). In this view, we can see mounting base plate 3 having holes 4 for bolting or screwing the pedestal to the floor or boat deck 2. In the center of mounting base plate 3 is hole 5 adapted to mount on a seat post receiver of a boat deck 2. Mounted to the mounting base plate 3 is front 6*a*, back 6*b*, left 6*c*, and right 6*d* rectangular shaped tubes mounted on the base to form a 4 sided right pyramid having a pyramidal apex 7. It can be seen in this view that tubes 6*c* and 6*d* are wider (more than twice width) than the 6*a* and 6*b* tubes facing viewer.

A stabilizing plate 10 is mounted horizontally between each of the seat posts 8*a* and 8*b* and the pyramidal apex 7, in this view by welding, in place. Stabilizing plate 10 has mounting holes 11 for mounting of accessories.

A left and right rectangular shaped seat posts 8*a* and 8*b*, each post having a proximal 13*a* and distal 13*b* end wherein the proximal end 13*a* of each is mounted one each perpendicularly 9 on the corresponding left 6*c* and right 6*d* tubes forming the pyramid and the distal end 13*b* has a seat mounting plate 15 adapted to receive seat 16.

Figure 2:
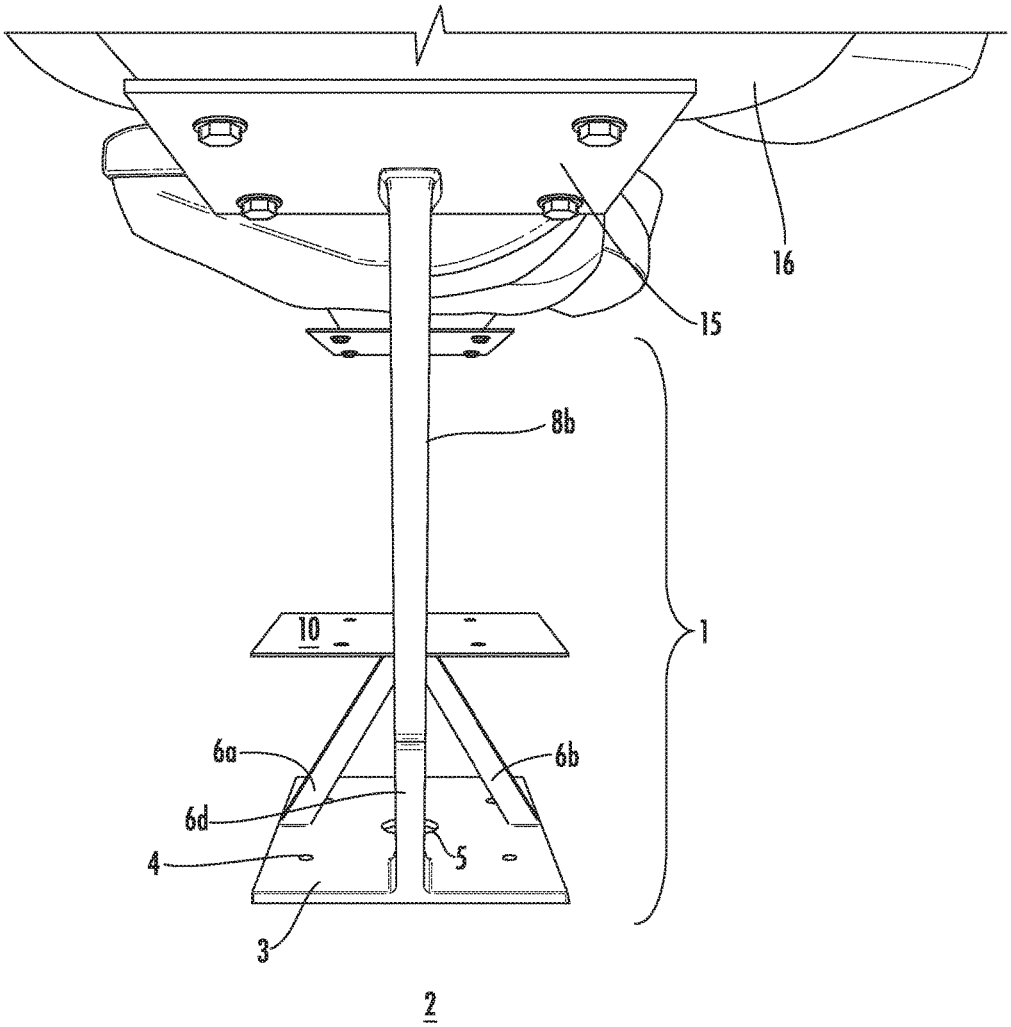
FIG. 2 is a side view of the present invention.

In FIG. 2 we see the pedestal from the side and we can see the tubes forming the pyramid, in this view, the tubes 6*a*, 6*b* and 6*d* (6*c* hidden from view) are the same width.

Figure 3:
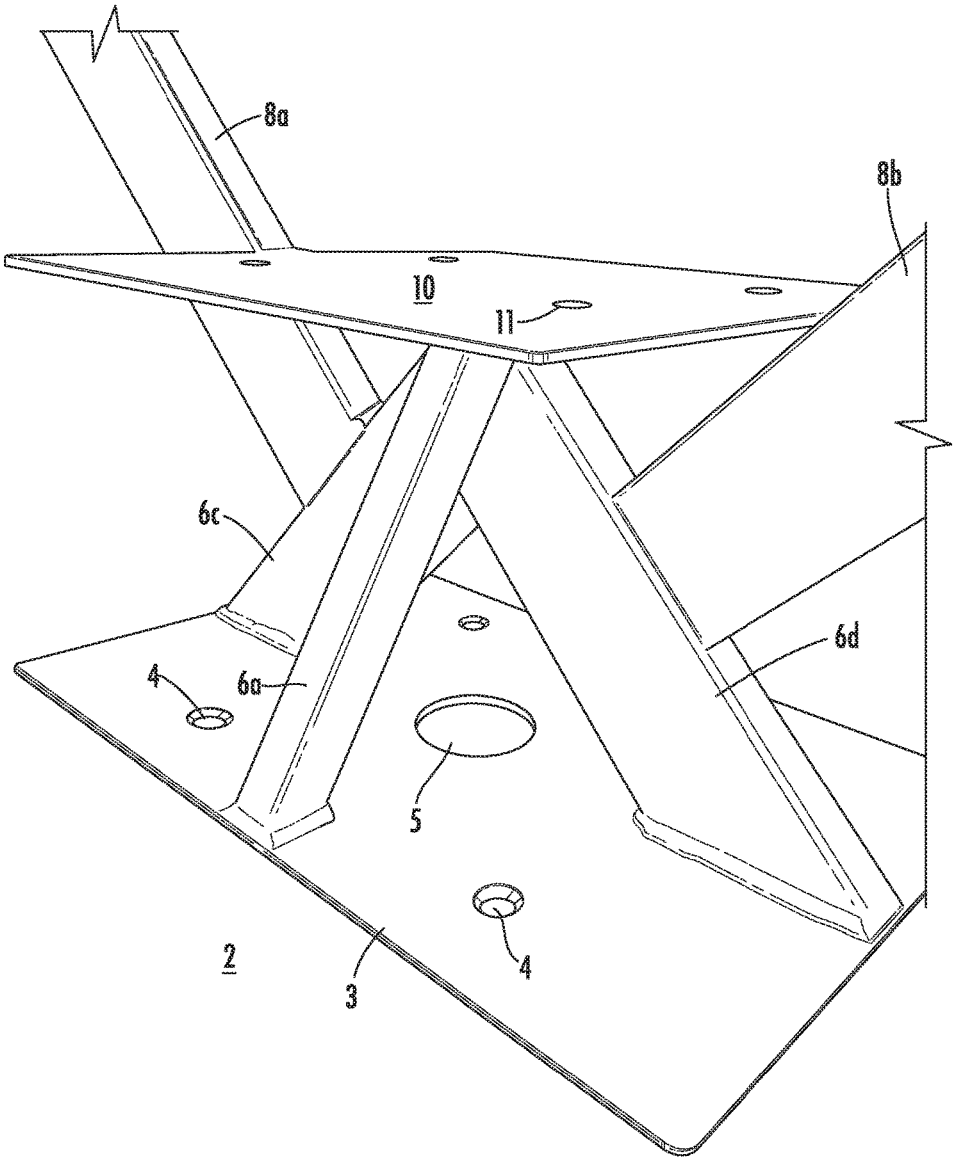
FIG. 3 is a perspective of the base and pyramidal support.
Figure 4:
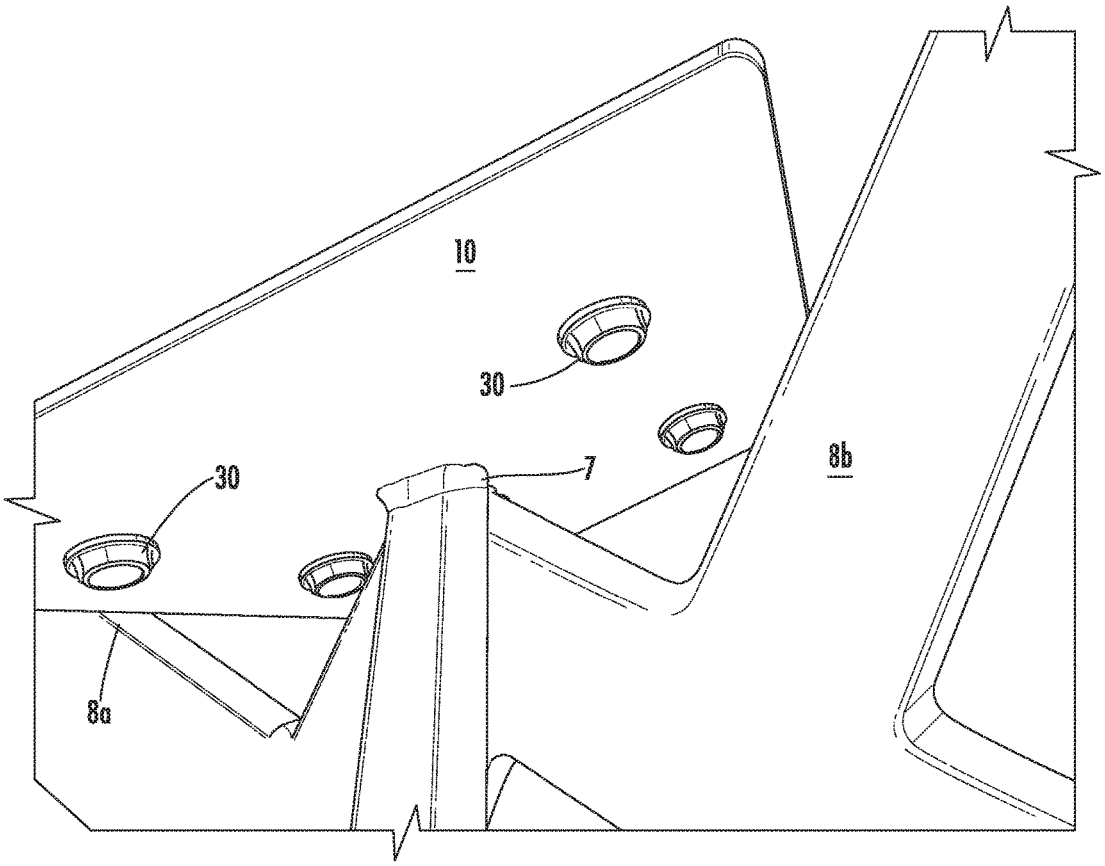
FIG. 4 is an underneath perspective of the stabilizing plate.

In FIG. 3 we see a close up of the pyramidal structure. In FIG. 4 we see an underneath view of the stabilizing plate 10 such that we can see that it is welded to pyramidal apex 7 and to seat posts 8*a* and 8*b*. In this view, we can see stabilizing plate 10 has bolt receivers 30 positioned in the holes of the stabilizing plate.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A seat pedestal for mounting two separate seats comprising:

a) a mounting plate base;

b) a front, back, left and right rectangular shaped tubes mounted on the base to form a 4 sided right pyramid having a pyramidal apex;

c) left and right rectangular shaped seat posts, each post having a proximal end and a distal end wherein the proximal end of each post is mounted one each perpendicularly on the corresponding left and right tubes forming the pyramid and the distal end has a seat mounting plate; and d) a stabilizing plate mounted between each of the seat posts and the pyramidal apex.

2. The seat pedestal according to claim 1 wherein the mounting plate, pyramidal tubes seat posts and stabilizing plate are all welded together.

3. The seat pedestal according to claim 1 wherein the mounting plate base is adapted for use with a seat post receiver.

4. The seat pedestal according to claim 1 wherein the mounting plate base is adapted to be used on a boat deck.

5. The seat pedestal according to claim 1 wherein there are a plurality of mounting holes on the mounting plate base.

6. The seat pedestal according to claim 1 wherein the left and right pyramid tubes have a width that is larger than the corresponding width of the front and back pyramidal tubes.

7. The seat pedestal according to claim 6 wherein the left and right pyramid tubes have a width that is at least twice the width of the corresponding width of the front and back pyramidal tubes.

8. The seat pedestal according to claim 1 wherein there is a seat mounted on each of the seat mounting plates.

9. The seat pedestal according to claim 1 wherein the stabilizing plate is adapted to receive one or more accessories mounted on holes in the stabilizing plate.

10. The seat pedestal according to claim 1 wherein the seat pedestal is mounted on a boat deck.

* * * * *